US012708217B2

(12) United States Patent
Kilic

(10) Patent No.: US 12,708,217 B2
(45) Date of Patent: Aug. 18, 2026

(54) DEVICE FOR MAKING BED

(71) Applicant: Sükrü Tayfun Kilic, Innsbruck (AT)

(72) Inventor: Sükrü Tayfun Kilic, Innsbruck (AT)

( * ) Notice: Subject to any disclaimer, the term of this patent is extended or adjusted under 35 U.S.C. 154(b) by 225 days.

(21) Appl. No.: 18/559,681

(22) PCT Filed: May 9, 2022

(86) PCT No.: PCT/EP2022/062397
§ 371 (c)(1),
(2) Date: Nov. 8, 2023

(87) PCT Pub. No.: WO2022/238283
PCT Pub. Date: Nov. 17, 2022

(65) Prior Publication Data

US 2024/0245223 A1 Jul. 25, 2024

(30) Foreign Application Priority Data

May 12, 2021 (EP) ..... 21173448

(51) Int. Cl.
*A47C 21/02* (2006.01)

(52) U.S. Cl.
CPC ..... *A47C 21/028* (2013.01); *A47C 21/022* (2013.01)

(58) Field of Classification Search
CPC ..... A47C 21/028; A47C 21/022; A47C 21/02
USPC ..... 5/504.1
See application file for complete search history.

(56) References Cited

U.S. PATENT DOCUMENTS 5,218,729 A * 6/1993 Walton ..... A47C 21/026 5/658
5,394,579 A * 3/1995 Walters ..... A47C 21/022 24/72.5
6,836,913 B2 * 1/2005 Perrin ..... A47C 21/022 24/72.5
7,152,260 B2 * 12/2006 Ota ..... A47C 21/022 24/72.5

(Continued)

FOREIGN PATENT DOCUMENTS

CA 1312388 C * 1/1993 ..... A47C 21/022
CN 217039477 U * 7/2022 ..... A47C 21/022

(Continued)

OTHER PUBLICATIONS

International Search Report and Written Opinion in Application No. PCT/EP2022/062397, mailed Aug. 31, 2022, 12 pages.

(Continued)

*Primary Examiner* — David E Sosnowski
(74) *Attorney, Agent, or Firm* — Meunier Carlin & Curfman LLC

(57) ABSTRACT

Device for making bed, which device comprises four parts, which parts are configured to be fixed at the corner areas of a mattress of the bed, wherein each of the parts of the device comprise an upper section with a surface configured to be placed against an upper surface of the mattress and a lower section with a surface configured to be placed against a lower surface of the mattress, and a fixing device for fixing a sheet to the part, which fixing device is connected to the part with a resilient biasing device, which biasing device allows the fixing means to be moved away from the part and to return to the part once released.

11 Claims, 3 Drawing Sheets

(56) References Cited

U.S. PATENT DOCUMENTS

| | | | | |
|---|---|---|---|---|
| 7,698,759 | B1 * | 4/2010 | Frasier | A47C 21/022 24/72.5 |
| 8,429,773 | B2 * | 4/2013 | Herman | A47C 21/022 24/72.5 |
| 9,254,046 | B1 * | 2/2016 | Arenstein | A47C 21/022 |
| 10,806,268 | B2 * | 10/2020 | Choi | A47G 9/04 |
| 11,064,811 | B2 * | 7/2021 | Guy | A47C 21/022 |

FOREIGN PATENT DOCUMENTS

| | | | | | |
|---|---|---|---|---|---|
| CN | 120225093 | A | * | 6/2025 | A47C 21/00 |
| EP | 4088622 | A1 | * | 11/2022 | A47C 21/028 |
| JP | 2005198824 | A | * | 7/2005 | A47C 21/022 |
| WO | WO-0182754 | A1 | * | 11/2001 | A47C 21/022 |
| WO | WO-2017009609 | A1 | * | 1/2017 | A47C 21/022 |
| WO | WO-2022238283 | A1 | * | 11/2022 | A47C 21/028 |
| WO | WO-2023199305 | A1 | * | 10/2023 | A47C 21/022 |

OTHER PUBLICATIONS

Search Report in European Application No. 21173448 dated Nov. 11, 2021, 2 pages.

* cited by examiner

DEVICE FOR MAKING BED

This application is a U.S. national stage application of the international patent application PCT/EP2022/062397 filed on May 9, 2022 and claiming priority of the European application number EP21173448.8 filed on May 12, 2021.

FIELD OF THE INVENTION

The present invention relates to a device assisting in the process of making bed.

BACKGROUND OF THE INVENTION

In accommodation business the beds of the residents and visitors needs typically to be made every day. In hotels, for example, this can easily mean hundreds and even thousands of beds to be made each day. And since this process is typically made with the personnel of the hotel or cleaning services, efficient fulfilling of this process typically means a lot of personnel hours.

Thus, any solutions or devices assisting and/or speeding up this bed making process has significant economic effect for the related costs.

SUMMARY OF THE INVENTION

The present invention provides a novel device assisting in the in bed making process, which significantly helps and speeds up the process. With the device of the present invention two main phases of the bed making process, namely manually stretching a sheet over mattress and pulling duvet cover over blanket, can be removed and/or significantly simplified, thus significantly decreasing the time used in the bed making process.

The device of the invention for making bed comprises four parts, which parts are configured to be fixed at the corner areas of a mattress of the bed, wherein each of the parts of the device comprise an upper section with a surface configured to be placed against an upper surface of the mattress and a lower section with a surface configured to be placed against a lower surface of the mattress, and a fixing device for fixing a sheet to the part, which fixing device is connected to the part with a resilient biasing device, which biasing device allows the fixing means to be moved away from the part and to return to the part once released.

By attaching the sheet to the fixing devices of the parts at the corner areas of the mattress the sheet on the mattress is effectively drawn tightly over the mattress with the biasing devices. Thus, the change of the sheet and stretching of the new sheet over mattress can be done quickly and easily. Further, the upper and lower sections of the parts allow easy and secure attachment of the parts of the device to the mattress of the bed.

In an embodiment of the device of the invention the upper section and lower section are connected to each other so that the distance between them is adjustable. In this embodiment the upper section and the lower section of the part of the device may preferably be connected to each other with elastic member or parts. The elastic members or parts allow tensioning of the upper and lower sections of the part at the corners of the mattress against the corresponding upper and lower surface of the mattress, which makes the attachment and fixing of the device of the invention even easier. Alternatively, the elastic member or parts can be replaced with a suitable telescopic part, for example, which allows adjustment of the distance between the upper section and lower section to be suitable for mattresses of different thicknesses.

In the above discussed two-section embodiment of the device of the invention the biasing device is also preferably connected to the lower section of the part of the device. In this embodiment the upper sections are preferably equipped with suitable means for detachably attaching the fixing device to the upper section, such as a hook for example, so that the fixing means are easily accessible during the changing of the sheet.

In the embodiment of the device of the invention two parts of the device, which parts are configured to be fixed to the adjacent corners of the mattress at the head of the bed, comprise additional fixing device attached to the part with further biasing device for temporary fixing of a sheet of a blanket or a blanket. This allows the utilization of the device of the invention also for changing the sheet of the blanket of the bed. The further biasing device are preferably connected to the upper sections of the parts.

In an embodiment of the device of the invention the device comprises guard parts configured to protect the mattress of the bed from the biasing devices. The guard parts can be implemented as a guard plates setting against corner areas of the mattress, or as a guide tubes or channels guiding the movement of the biasing devices, for example.

In an embodiment of the device of the invention the device the sections of the parts of the device are preferably made from plastic.

In an embodiment of the device of the invention the biasing device comprises a spring reel retractor, and the fixing device comprises a crocodile clip. Alternatively other similar devices, such as springs and/or elastic bands may be used in the biasing device for example, and hooks, clips and other known fastening means in the fixing device for example.

The present invention also provides a mattress comprising a device of the invention. The device of the invention may be integrated to the mattress during the manufacturing of the mattress, for example.

More precisely the features defining a device in accordance with the present invention are presented in the independent claims. Dependent claims present advantageous features and embodiments of the invention.

BRIEF DESCRIPTION OF THE DRAWINGS

Exemplifying embodiment of the invention and its advantages are explained in greater detail below in the sense of example and with reference to accompanying drawings, where.

DETAILED DESCRIPTION OF THE INVENTION

Figure 1:
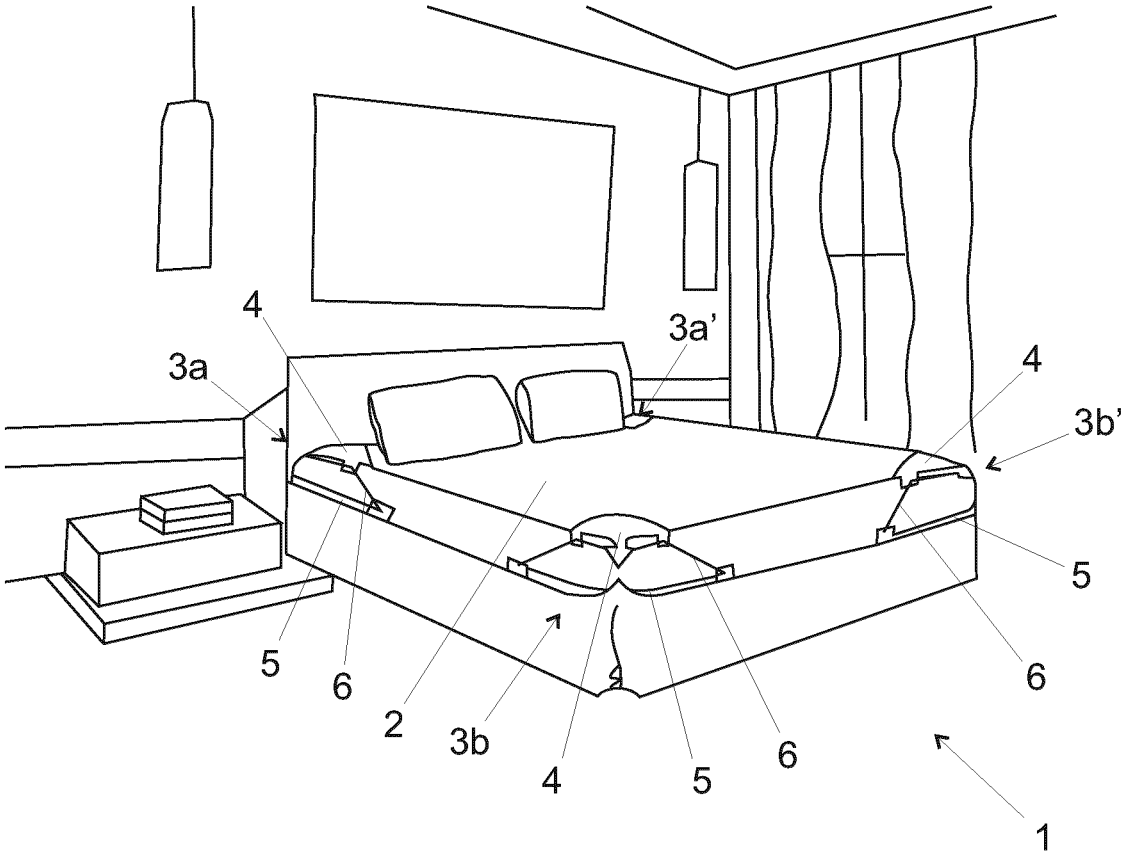
FIG. 1 shows schematically a bed equipped with an embodiment of the device of the invention.

In FIG. 1 is schematically shown a bed 1 of which mattress 2 is equipped with an embodiment of the device of the invention. The device in this embodiment comprises a four parts 3*a*, 3*a*', 3*b* and 3*b*', which parts are located at the corner areas of the mattress 2.

In this embodiment each of the parts 3*a*, 3*a*', 3*b* and 3*b*' comprises an upper section 4 and lower section 5. The upper sections 4 are set on the upper surface of the mattress 2 and the lower sections 5 are set on the lower surface of the mattress. Both the upper and lower sections 4, 5 also comprises small portions extending on the side surfaces of the mattress 2 for helping in the proper positioning of the sections on the corners of the mattress.

The upper sections 4 and the lower sections 5 are connected to each other in this embodiment with an elastic band 6, which keeps the sections pressed against the surface of the mattress 2, and at their places on the corners of the mattress. Alternatively, the elastic band 6 could be replaced for example with a telescopic connection allowing the distance between the upper section 4 and lower section 5 to be adjusted based on the thickness of the mattress 2.

Figure 2A:
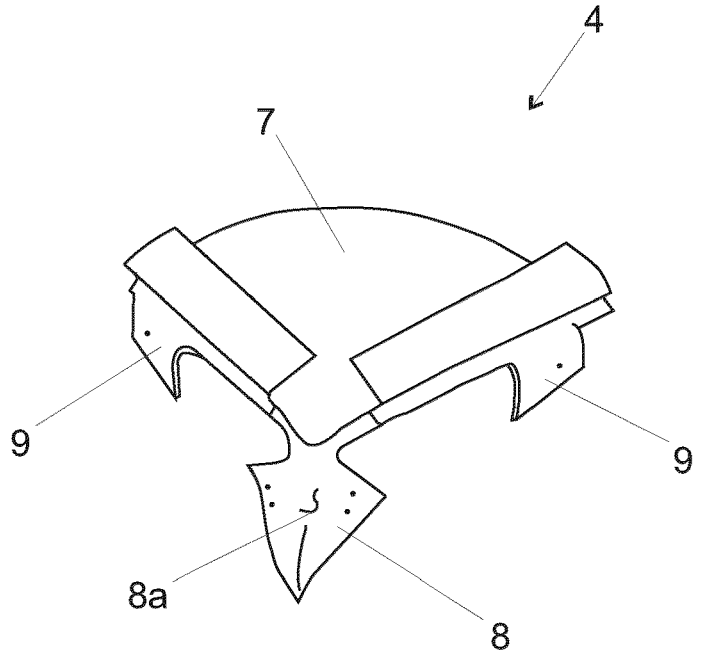
FIGS. 2A and 2B shows schematically embodiments of a piece of the device of the invention.

FIG. 2A shows schematically an embodiment of the upper section 4 of the parts 3*b*, 3*b*' of the device of the invention that are located at the foot end of the bed 1. In this embodiment the upper section 4 comprises a surface 7 setting against the upper surface of the mattress 2, and portions 8 and 9 extending substantially perpendicularly in relation to the surface 7. The portions 9 are set against the side surfaces of the mattress 2 and the portion 8 is set in the corner of the mattress.

The portions 8 and 9 comprise hooks for allowing the elastic band 6 to be fixed to the upper section 4, which hooks projects inwards towards the mattress 2 when the upper section is at its place. In this embodiment, the ends or the elastic bands 6 are connected to hooks in the portion 8, and the elastic bands extend via hooks in the portions 9 to the lower section 5 discussed in more detail with reference to FIGS. 3A and 3B.

The portion 8 is also equipped with an outward projecting hook 8*a*. To this hook 8*a* can be attached a crocodile clip 13 of the lower sections 5 (see 3B) when the sheets of the bed 1 are changed, so that the crocodile clip is easily accessible at least for attaching a new bed sheet to it. After fastening of the new sheet to the crocodile clip 13 (FIG. 3B), mere sideway push preferably detaches the crocodile clip from the hook 8*a*.

Figure 2B:
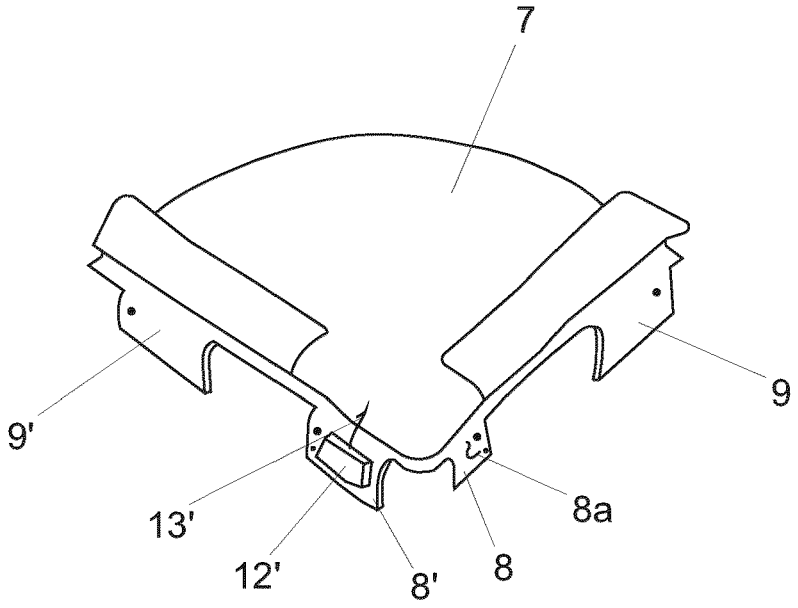

FIG. 2B shows schematically an embodiment of the upper section 4 of the parts 3*a*, 3*a*' for the of the device of the invention that are located at the head end of the bed 1. Similarly than in the upper section of FIG. 2A, the upper section 4 comprises a surface 7 setting against the upper surface of the mattress 2, and portions 8, 8' and 9, 9' extending substantially perpendicularly in relation to the surface 7. The portions 8, 8' and 9, 9' are set against the side surfaces of the mattress 2 so that portion 8' and portion 9' next to it are located towards the head of the bed 1, and portions 8 and 9 are located at the side of the mattress 2.

Figure 3A:
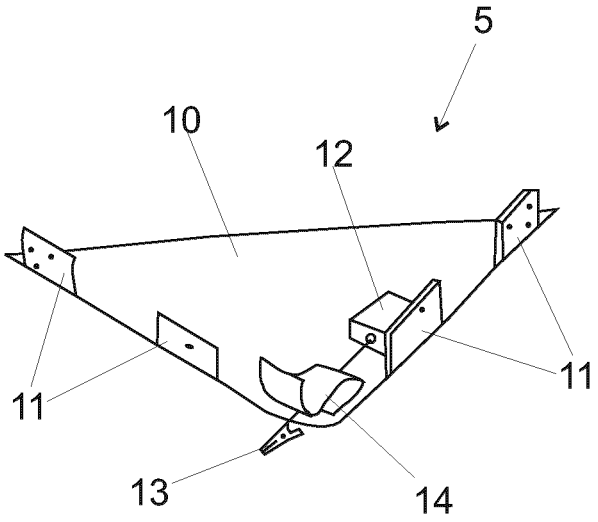
FIGS. 3A and 3B show schematically embodiments of another piece of the device of the invention.

Similarly than in the upper section of FIG. 2A, the portion 8 comprises an outwardly projecting hook 8*a* for holding a crocodile clip from the lower section 5 discussed in relation to FIG. 3A. Further, also the portions 8, 8' and 9, 9' comprise hooks for allowing the elastic band 6 to be fixed to the upper section 4, which hooks projects inwards towards the mattress 2 when the lower section is at its place.

In the portion 8' is also attached a spring reel retractor 12', to which string is attached a crocodile clip 13'. When a duvet cover of a blanket of the bed 1 is changed, the crocodile clip 13' is attached either to the blanket or to the duvet cover so that the retractive force of the spring reel retractor 12' can be used to help to get a new duvet cover on the blanket.

FIG. 3A shows schematically an embodiment of the lower section 5 of the parts 3*a*, 3*a*' of the device of the invention located at the head of the bed 1. In this embodiment the lower section 5 comprises a surface 10 setting against the lower surface of the mattress 2, and portions 11 extending substantially perpendicularly in relation to the surface 10. The portions 11 are set against the side surfaces of the mattress 2. The portions 11 also comprise inward, i.e. towards the mattress 2, projecting hooks for allowing the elastic band 6 to be fixed to the lower section 5. These inward projecting hooks can be used to tighten the elastic bands 6 to proper tension.

To the surface 10 of the lower section 5 is fixed a spring reel retractor 12, to which string is attached a crocodile clip 13. The crocodile clip 13 fixed on a sheet to be set on the mattress 2, and the released so that the retractor 12 will pull the sheet tightly over the mattress and keep it there. With the retractor 12, the detachment of the crocodile clip 13 from the hook 8*a* of the upper section 4 allows the retractor to pull the sheet at its fixed and tight position on the mattress 2.

The lower section 5 also preferably comprises a guard part 14, through which the string of the spring reel retractor 12 goes. This guard part 14 protects the mattress 2, especially the lower edge of the mattress, from the string of the spring reel retractor 12 and guides the string, when the string moves during operation of the device during the changing of the sheets of the bed 1.

In these lower parts 5 of the parts 3*a* and 3*a*' located at the head of the bed 1, the spring reel retractor 12 and the guard part 14 are preferably connected to the surface 10 so, that the crocodile clip 13 is accessible on that side of the mattress 2 which is not against the head of the bed.

Figure 3B:
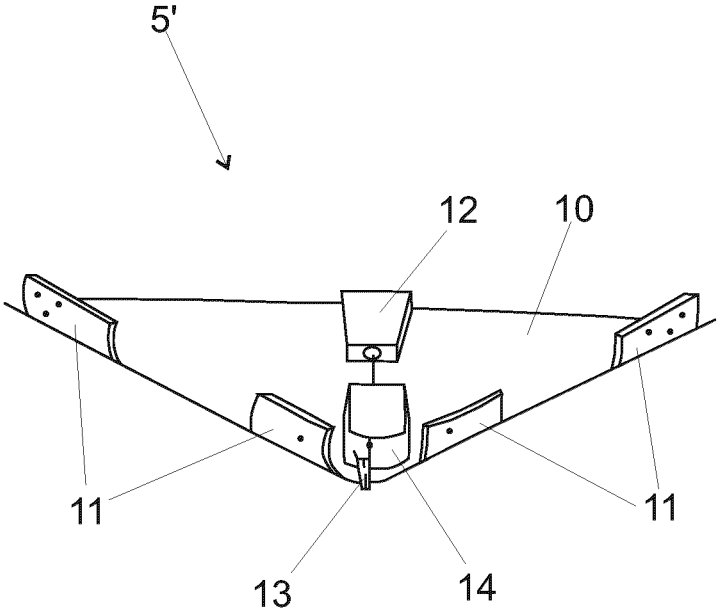

FIG. 3B shows schematically an embodiment of the lower section 5' of the parts 3*b*, 3*b*' of the device of the invention which are located on the foot end of the mattress 2. Similarly than in embodiment of FIG. 3A, the lower section 5' comprises a surface 10 setting against the lower surface of the mattress 2, and portions 11 extending substantially perpendicularly in relation to the surface 10. The portions 11 are set against the side surfaces of the mattress 2. The portions 11 also comprise holes and/or hooks for allowing the elastic band 6 to be fixed to the lower section 5.

In the lower sections 5 of the parts 3*b*, 3*b*', the spring reel retractor 12 together with the guard 14 are preferably connected to the surface 10 so, that the crocodile clip 13 is accessible from the corner of the lower section 5 and of the mattress 2.

In relation to the above embodiment it is to be noted, that the key parts of the device can also be integrated as a part of the mattress itself during the manufacturing of the mattress, for example.

Further, in relation to the embodiment disclosed in the figures the sheet for the mattress is preferably stitched to the form for the corners of the mattress at the foot of the bed and the edges of the sheet preferably are dimensioned to end substantially at the lower edges of the mattress with the exception of the head end of the bed, where the sheet preferably ends substantially at the top and side surface edges of the mattress. This way the spring reel retractors keep the sheet tensioned over the mattress and there is no need to tuck the edges of the sheet under mattress.

In an embodiment where the upper section and lower section are integrated into a single piece, preferably via a telescopic connecting part, the lower section is preferably provided with suitable means for momentarily raising the edge of the mattress, so that the spring reel retractors can pull the edge of the sheet under the mattress. This embodiment allows the use of a normal sheet with the mattress. The means for momentarily raising the edge of the mattress can be implemented with a suitable spring device, for example.

The specific exemplifying embodiment of the invention shown in figures and discussed above should not be construed as limiting. A person skilled in the art can amend and modify the embodiment described in many evident ways within the scope of the attached claims. Thus, the invention is not limited merely to the embodiment described above.

The invention claimed is:

1. A device for making a bed, which device comprises four parts, which parts are configured to be fixed at corner areas of a mattress of the bed, wherein each of the parts of the device comprise an upper section with a surface configured to be placed against an upper surface of the mattress and a lower section with a surface configured to be placed against a lower surface of the mattress, and a fixing device removably couplable to a sheet, wherein the fixing device is connected to the part via a resilient biasing retractor device, wherein the resilient biasing retractor device allows the fixing device to be moved away from the part and to return to the part once released, wherein the resilient biasing retractor device biases the fixing device towards the part for pulling the sheet coupled to the fixing device over the mattress.

2. The device according to claim 1, wherein, with regard to each of the parts, the upper section and lower section are connected to each other so that the distance between them is adjustable.

3. The device according to claim 2, wherein, with regard to each of the parts, the upper section and the lower section of the part of the device are connected to each other with an elastic member or parts allowing tensioning between the upper section and lower section for pressing these sections against surfaces of the mattress.

4. The device according to claim 1, wherein, with regard to each of the parts, the biasing device is connected to the lower section.

5. The device according to claim 4, wherein, with regard to each of the parts, the upper section comprises means for detachably attaching a respective one of the fixing devices to the upper section.

6. The device according to claim 1, wherein two parts of the device, which parts are configured to be fixed to the corners of the mattress at the head of the bed, comprise additional fixing devices attached to the parts with further resilient biasing devices for temporary fixing of a duvet cover for a blanket or a blanket.

7. The device according to claim 6, wherein the further biasing devices are connected to the upper sections of the parts.

8. The device according to claim 1, further comprising guard parts configured to protect the mattress of the bed from the biasing devices.

9. The device according to claim 1, wherein the sections of the parts are made of plastic.

10. The device according claim 1, wherein each resilient biasing device comprises a spring reel retractor, and each fixing device comprises a crocodile clip.

11. A mattress comprising a device according to claim 1.

* * * * *